US010449655B2

(12) United States Patent
Shibuya et al.

(10) Patent No.: US 10,449,655 B2
(45) Date of Patent: Oct. 22, 2019

(54) WORK POLISHING METHOD AND WORK POLISHING APPARATUS

(71) Applicants: Fujikoshi Machinery Corp., Nagano (JP); Kanazawa Institute of Technology, Ishikawa (JP)

(72) Inventors: Kazutaka Shibuya, Nagano (JP); Yoshio Nakamura, Nagano (JP); Michio Uneda, Ishikawa (JP); Kenichi Ishikawa, Ishikawa (JP)

(73) Assignees: FUJIKOSHI MACHINERY CORP., Nagano (JP); KANAZAWA INSTITUTE OF TECHNOLOGY, Ishikawa (JP)

( * ) Notice: Subject to any disclaimer, the term of this patent is extended or adjusted under 35 U.S.C. 154(b) by 169 days.

(21) Appl. No.: 15/860,794

(22) Filed: Jan. 3, 2018

(65) Prior Publication Data

US 2018/0207768 A1 Jul. 26, 2018

(30) Foreign Application Priority Data

Jan. 23, 2017 (JP) ..... 2017-009505

(51) Int. Cl.
*B24B 53/017* (2012.01)
*B24B 37/10* (2012.01)
*B24B 49/12* (2006.01)

(52) U.S. Cl.
CPC ..... *B24B 53/017* (2013.01); *B24B 37/107* (2013.01); *B24B 49/12* (2013.01)

(58) Field of Classification Search
CPC ..... B24B 53/017; B24B 37/107; B24B 49/12
USPC ..... 451/5, 6, 41, 285–290, 443, 56
See application file for complete search history.

(56) References Cited

U.S. PATENT DOCUMENTS 5,402,354 A * 3/1995 Okino ..... B24B 51/00 451/5
7,008,301 B1 * 3/2006 Raeder ..... B24B 37/042 451/285
7,846,006 B2 * 12/2010 Stinson ..... B24B 53/017 451/10
9,138,860 B2 * 9/2015 Dhandapani ..... B24B 53/017
(Continued)

FOREIGN PATENT DOCUMENTS

JP 2001260001 9/2001
JP 5366041 12/2013

*Primary Examiner* — George B Nguyen
(74) *Attorney, Agent, or Firm* — Stephen J. Weyer, Esq.; Stites & Harbison, PLLC

(57) ABSTRACT

The polishing apparatus comprises: a dressing section for dressing a polishing pad; a measuring section for measuring a surface property of the polishing pad; a polishing result measuring section for measuring a polishing result of a work; a storing section for storing correlation data between dressing condition data for dressing the polishing pad, surface property of the polishing pad and polishing results, which are learned by an artificial intelligence; and an input section for inputting an object polishing result. The artificial intelligence performs a first arithmetic process, in which the surface property of the polishing pad corresponding to the object polishing result is inversely estimated on the basis of the correlation data, and a second arithmetic process, in which the corresponding dressing condition is derived on the basis of the surface property of the polishing pad inversely estimated.

21 Claims, 11 Drawing Sheets

(56) References Cited

U.S. PATENT DOCUMENTS

| | | | | |
|---|---|---|---|---|
| 9,669,514 | B2 * | 6/2017 | Lai | B24B 49/105 |
| 10,207,390 | B2 * | 2/2019 | Shimizu | B24B 37/013 |
| 2002/0142706 | A1 * | 10/2002 | Glashauser | B24B 37/042 451/41 |
| 2004/0023602 | A1 * | 2/2004 | Moloney | B24B 37/042 451/56 |
| 2004/0043698 | A1 * | 3/2004 | Jiang | B24B 37/26 451/5 |
| 2006/0019584 | A1 * | 1/2006 | Skocypec | B24B 53/017 451/56 |
| 2009/0036041 | A1 * | 2/2009 | Matsuzaki | B24B 53/017 451/287 |
| 2009/0137190 | A1 * | 5/2009 | Togawa | B24B 37/013 451/8 |
| 2009/0221216 | A1 * | 9/2009 | Fujita | B24B 53/017 451/56 |
| 2010/0197197 | A1 * | 8/2010 | Nakayoshi | B24B 37/042 451/5 |
| 2016/0184960 | A1 * | 6/2016 | Matsuo | B24B 37/005 451/5 |

* cited by examiner (a) #80

FIG.16

| SAMPLE No. | CLASS | NUMBER OF CONTACT POINTS | CONTACT RATIO | SPACING | FFT | POLISHING RATE |
|---|---|---|---|---|---|---|
| 1 | A | 22.5 | 0.43 | 551 | 81.6 | 3.57 |
| 2 | C | 38.5 | 0.72 | 550 | 86.3 | 7.01 |
| 3 | BC | 55.2 | 1.31 | 528 | 188 | 6.87 |
| 4 | CA | 18.7 | 0.78 | 629 | 174 | 6.87 |
| 5 | C | 31.7 | 0.80 | 611 | 105 | 7.20 |
| 6 | BC | 55.0 | 1.29 | 650 | 173 | 5.93 |
| 7 | A | 23.2 | 0.17 | 397 | 64.5 | 4.25 |
| 8 | C | 42.1 | 0.28 | 343 | 118 | 8.04 |
| 9 | A | 27.6 | 0.28 | 380 | 120 | 2.68 |
| 10 | C | 41.4 | 0.28 | 315 | 63 | 7.40 |
| 11 | BC | 51.3 | 0.30 | 319 | 100 | 7.46 |
| 12 | CA | 24.3 | 0.36 | 670 | 178 | 3.75 |
| 13 | AC | 30.6 | 0.30 | 685 | 116 | 6.67 |
| 14 | CA | 18.7 | 0.23 | 469 | 83.0 | 1.54 |
| 15 | AC | 33.8 | 0.52 | 333 | 86.7 | 8.24 |
| 16 | A | 19.4 | 0.34 | 478 | 60.1 | 3.72 |
| 17 | A | 19.3 | 0.29 | 442 | 69.6 | 4.48 |
| 18 | C | 28.9 | 0.50 | 398 | 73.3 | 5.47 |
| 19 | C | 27.0 | 0.34 | 415 | 54.5 | 6.80 |
| 20 | BC | 43.5 | 0.64 | 366 | 79.5 | 9.15 |
| 21 | BC | 42.5 | 0.57 | 390 | 90.1 | 9.51 |
| 22 | A | 23.9 | 0.38 | 420 | 72.6 | 4.55 |
| 23 | A | 26.6 | 0.40 | 368 | 91.5 | 4.44 |
| 24 | AC | 43.2 | 0.47 | 336 | 79.7 | 8.75 |
| 25 | AC | 43.8 | 0.52 | 360 | 106 | 7.73 |
| 26 | A | 12.1 | 0.59 | 1440 | 220 | 1.41 |
| 27 | A | 19.0 | 0.84 | 1114 | 220 | 1.76 |
| 28 | A | 22.8 | 0.90 | 1099 | 209 | 2.79 |
| 29 | A | 15.5 | 0.65 | 1122 | 172 | 3.48 |
| 30 | A | 15.8 | 0.58 | 1023 | 168 | 2.52 |
| 31 | A | 15.4 | 0.59 | 971 | 156 | 3.20 |
| 32 | A | 18.3 | 0.67 | 880 | 153 | 3.33 |
| 33 | A | 18.2 | 0.62 | 1101 | 171 | 2.83 |
| 34 | A | 15.1 | 0.51 | 881 | 145 | 3.53 |
| 35 | AC | 25.6 | 0.934 | 1036 | 235 | 1.83 |
| 36 | AC | 23.1 | 0.616 | 1082 | 210 | 3.13 |
| 37 | AC | 23.9 | 0.463 | 1117 | 153 | 3.30 |
| 38 | AC | 27.9 | 0.653 | 1221 | 162 | 5.55 |
| 39 | AC | 14.6 | 0.231 | 1044 | 92.4 | 5.53 |
| 40 | AC | 23.4 | 0.374 | 1049 | 129 | 7.06 |

| SAMPLE No. | CLASS | NUMBER OF CONTACT POINTS | CONTACT RATIO | SPACING | FFT | POLISHING RATE |
|---|---|---|---|---|---|---|
| 41 | AC | 30.2 | 0.548 | 810 | 116 | 6.11 |
| 42 | AC | 31.0 | 0.552 | 880 | 130 | 4.78 |
| 43 | AC | 37.5 | 0.604 | 876 | 143 | 5.90 |
| 44 | B | 28.7 | 0.78 | 884 | 150 | 7.35 |
| 45 | B | 36.3 | 0.84 | 893 | 137 | 9.36 |
| 46 | B | 34.8 | 0.87 | 935 | 142 | 9.32 |
| 47 | B | 21.4 | 0.58 | 811 | 102 | 8.72 |
| 48 | B | 26.8 | 0.66 | 863 | 121 | 8.09 |
| 49 | B | 24.7 | 0.71 | 743 | 117 | 7.81 |
| 50 | B | 20.9 | 0.71 | 831 | 88.4 | 6.43 |
| 51 | B | 22.2 | 0.70 | 819 | 97.7 | 5.72 |
| 52 | B | 23.7 | 0.76 | 757 | 94.8 | 5.12 |
| 53 | A | 13.8 | 0.72 | 1360 | 224 | 1.73 |
| 54 | A | 14.4 | 0.79 | 1261 | 221 | 2.47 |
| 55 | A | 18.1 | 0.79 | 1162 | 212 | 3.17 |
| 56 | A | 14.5 | 0.65 | 911 | 153 | 4.10 |
| 57 | A | 18.0 | 0.77 | 707 | 161 | 4.17 |
| 58 | A | 10.7 | 0.43 | 1123 | 151 | 4.43 |
| 59 | A | 20.2 | 0.8 | 824 | 170 | 4.76 |
| 60 | A | 14.2 | 0.53 | 915 | 150 | 5.67 |
| 61 | A | 15.9 | 0.59 | 881 | 160 | 5.76 |
| 62 | AC | 35.1 | 0.86 | 886 | 213 | 5.89 |
| 63 | AC | 24.5 | 0.69 | 912 | 148 | 6.73 |
| 64 | AC | 32.2 | 0.78 | 805 | 173 | 7.26 |
| 65 | — | 21.4 | 1.15 | 1537 | 320 | 1.40 |
| 66 | A | 15.8 | 0.90 | 938 | 193 | 3.18 |
| 67 | A | 14.5 | 0.61 | 1043 | 187 | 4.17 |
| 68 | A | 18.5 | 0.72 | 826 | 177 | 3.58 |
| 69 | CA | 25.3 | 0.68 | 754 | 164 | 7.09 |
| 70 | — | 32.9 | 1.01 | 859 | 201 | 6.41 |
| 71 | — | 28.1 | 0.93 | 834 | 199 | 6.13 |
| 72 | — | 27.1 | 0.91 | 856 | 203 | 5.85 |
| 73 | — | 61.9 | 2.05 | 867 | 256 | 5.80 |
| 74 | — | 38.6 | 1.33 | 876 | 245 | 5.21 |
| 75 | — | 27.0 | 1.06 | 913 | 307 | 5.47 |

WORK POLISHING METHOD AND WORK POLISHING APPARATUS

CROSS-REFERENCE TO RELATED APPLICATION

This application is based upon and claims the benefit of priority of the prior Japanese Patent Application No. 2017-009505, filed on Jan. 23, 2017, and the entire contents of which are incorporated herein by reference.

FIELD

The present invention relates to a method and an apparatus for polishing a work, e.g., semiconductor wafer.

BACKGROUND

Polishing a work, e.g., semiconductor wafer, is performed by steps of: pressing a surface of the work to be polished onto a surface of a polishing pad adhered on a polishing plate; supplying slurry onto the polishing pad; and rotating the polishing plate.

However, by polishing many works, the polishing pad is gradually clogged, and a polishing rate is lowered. To solve this problem, the polishing rate is recovered by dressing the surface of the polishing pad, by using a dressing grindstone, after polishing works a prescribed number of times (see PTL 1: JP-A-2001-260001).

PTL 1 discloses a method for flattening a semiconductor wafer by using a dressing rate measuring unit for measuring a polishing rate of a polishing pad, which is varied with progress of polishing, and a surface property measuring unit for measuring a surface property of the polishing pad. In the method, a dressing condition is controlled so as to keep the dressing rate, which seriously influences on a scratch density, within a prescribed management value range which has been previously stored in a database.

In PTL 1, the surface property of the polishing pad is measured by an image processing manner or a manner of measuring a reflection rate.

In the image processing manner, the surface of the polishing pad is irradiated by a light projector, an image of the irradiated part is extracted by a CCD camera, the image is processed, and an area ratio of a flat part of the polishing pad formed by clogging is measured. On the other hand, in the manner of measuring a reflection rate, a laser beam is applied to the surface of the polishing pad, the reflected laser beam is received by a light receiving unit, and the surface property of the polishing pad is measured on the basis of light quantity variations of the received laser beam.

In PTL 1, the surface property of the polishing pad is measured and the surface thereof is dressed while polishing the work, so that there is an advantage that dressing the polishing pad can be suitably performed according to the momentarily varying surface property of the polishing pad.

However, in PTL 1, the surface property of the polishing pad is measured while polishing the work, so an image different from the actual one will be obtained or an unclear image will be obtained due to polishing dusts and slurry (e.g., cloudy liquid). Therefore, precise data of the surface property of the polishing pad cannot be obtained.

Further, the surface property of the polishing pad cannot be correctly obtained, so it is often obtained on the basis of operators' experiences, even now. This problem impedes automatizing the polishing process and making intelligent the same.

SUMMARY

The present invention has been invented to solve the above described problems. Conventionally, it is difficult to automatize a polishing process and make the same intelligent. Firstly, the inventors tried to correctly detect a surface property of a polishing pad, and then tried to produce an intelligent polishing system capable of automatically indicating polishing conditions by employing a self-learning artificial intelligence, e.g., neural network.

Thus, an object of the present invention is to provide a work polishing method and a work polishing apparatus, each of which is capable of correctly know a surface property of a polishing pad, precisely dressing the polishing pad and automatically producing desired polishing conditions.

SOLUTION TO PROBLEM

To achieve the object, the present invention has following structures.

Namely, the work polishing apparatus of the present invention, in which a work is pressed onto a polishing pad of a rotating polishing plate with supplying slurry to the polishing pad so as to polish a surface of the work, comprises:

an artificial intelligence for analyzing data;

a dressing section having a grind stone, the grind stone being capable of reciprocally moving on a surface of the polishing pad so as to dress the surface of the polishing pad under a prescribed dressing condition;

a surface property measuring section for measuring a surface property of the polishing pad, the surface property measuring section obtaining a contact image of the polishing pad in a state of contacting the surface thereof;

a polishing result measuring section for measuring a polishing result of the work which has been polished by the polishing pad dressed by the dressing section;

a storing section for storing correlation data between dressing condition data for dressing the polishing pad by the dressing section, surface property data of the polishing pad measured by the surface property measuring section after dressing the polishing pad and polishing results of the work polished after dressing the polishing pad, the correlation data being learned by the artificial intelligence; and an input section for inputting an object polishing result to the artificial intelligence, and a learning algorithm for performing a first arithmetic process, in which the surface property of the polishing pad corresponding the object polishing result is inversely estimated on the basis of the correlation data, and a second arithmetic process, in which the corresponding dressing condition is derived on the basis of the surface property of the polishing pad inversely estimated, are mounted on the artificial intelligence.

In the work polishing apparatus, the dressing section may have a plurality of grindstones to which abrasive grains having different grain sizes are respectively fixed.

In the work polishing apparatus, the surface property of the polishing pad may include at least number of contact points in the contact image.

In the work polishing apparatus, the surface property of the polishing pad may include number of contact points in the contact image, a contact ratio, a specing between the contact points and a spatial FFT analysis result.

In the work polishing apparatus, the artificial intelligence may perform the first arithmetic process for inversely estimating the surface property of the polishing pad by using a first neural network, and performs the second arithmetic process for deriving the dressing condition by using a second neural network.

In the work polishing apparatus, the artificial intelligence may perform the first arithmetic process for inversely estimating the surface property of the polishing pad by using a neural network, and performs the second arithmetic process for deriving the dressing condition by using an image recognition technology.

The work polishing method of the present invention, in which a work is pressed onto a polishing pad of a rotating polishing plate with supplying slurry to the polishing pad so as to polish a surface of the work, comprises:

a dressing step of reciprocally moving a grind stone on a surface of the polishing pad so as to dress the surface of the polishing pad under a prescribed dressing condition;

a measuring step of measuring a surface property of the polishing pad by a surface property measuring section, the surface property measuring section obtaining a contact image of the polishing pad in a state of contacting the surface thereof;

a polishing step of polishing the work after dressing the polishing pad;

a measuring step of measuring a polishing result of the polished work;

an obtaining step of obtaining correlation data between the dressing data for dressing the polishing pad by the dressing section, surface property data of the polishing pad measured by the surface property measuring section after dressing the polishing pad and polishing results of the work polished after dressing the polishing pad, which are learned by an artificial intelligence;

an inputting step of inputting an object polishing result to the artificial intelligence;

a first arithmetic step of inversely estimating the surface property of the polishing pad corresponding to the object polishing result on the basis of the correlation data by the artificial intelligence; and a second arithmetic step of deriving the corresponding dressing condition on the basis of the surface property of the polishing pad inversely estimated by the artificial intelligence.

In the work polishing method, the dressing section may have a plurality of grindstones to which abrasive grains having different grain sizes are respectively fixed.

In the work polishing method, the surface property of the polishing pad may include at least number of contact points in the contact image.

In the work polishing method, the surface property of the polishing pad may include number of contact points, a contact ratio, a spacing between the contact points and a spatial FFT analysis result in the contact image.

In the work polishing method, the artificial intelligence may perform the first arithmetic process for inversely estimating the surface property of the polishing pad by using a first neural network, and performs the second arithmetic process for deriving the dressing condition by using a second neural network.

In the work polishing method, the artificial intelligence may perform the first arithmetic process for inversely estimating the surface property of the polishing pad by using a neural network, and performs the second arithmetic process for deriving the dressing condition by using an image recognition technology.

By the present invention, the inventors succeeded to quantitatively evaluate the surface property of the polishing pad, which includes many scientifically-unsolved matters, and to learn the correlation data between the surface property of the polishing pad and the polishing results, e.g., polishing rate, with storing the correlation data. Therefore, the surface property of the polishing pad, which corresponds to a desired polishing result, can be estimated, and the dressing condition capable of produce the estimated surface property can be automatically derived. Namely, intelligent polishing can be realized by using the surface property of the polishing pad as a key.

BRIEF DESCRIPTION OF THE DRAWINGS

Embodiments of the present invention will now be described by way of examples and with reference to the accompanying drawings, in which:

FIG. 16 is an explanation view showing verifying experimental data of the relation between the surface properties of the polishing pad and the polishing rates;

DESCRIPTION OF THE EMBODIMENTS

Preferred embodiments of the present invention will now be described in detail with reference to the accompanying drawings.

Figure 1:
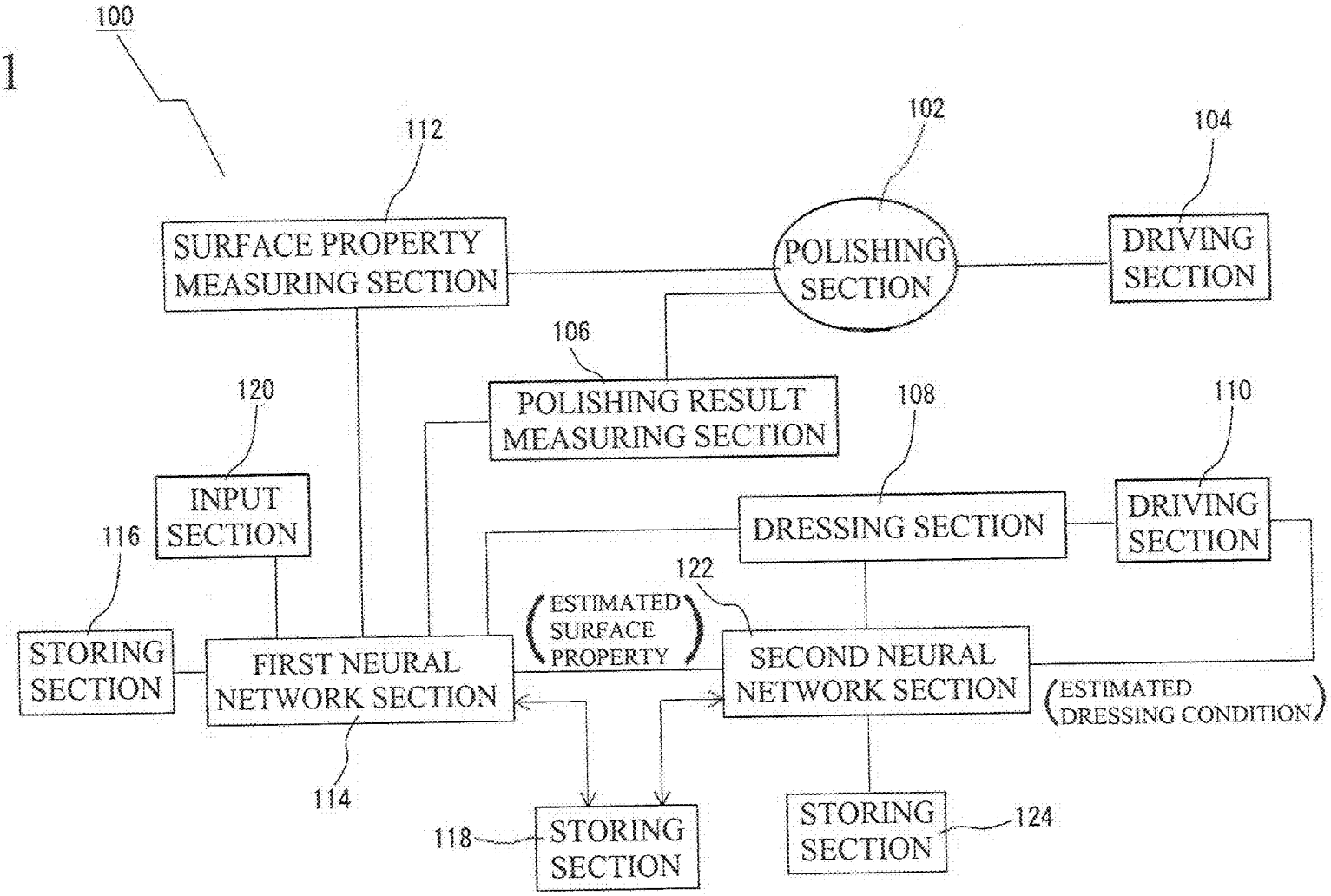
FIG. 1 is a block diagram schematically showing an entire structure of a work polishing apparatus.
Figure 2:
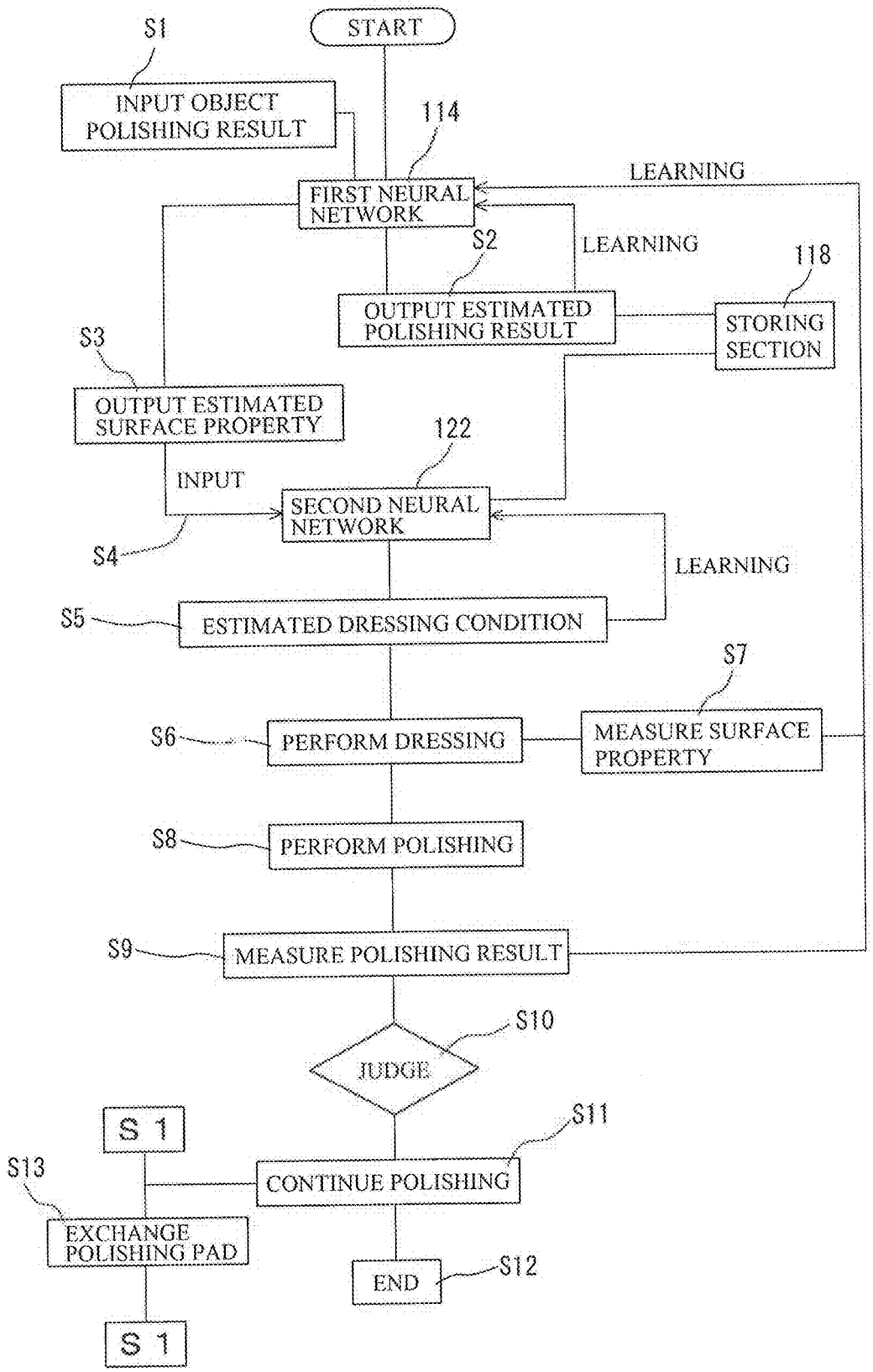
FIG. 2 is a flowchart showing actions of the work polishing apparatus.

FIG. 1 is a block diagram schematically showing an entire structure of a work polishing apparatus 100. FIG. 2 is a flowchart showing actions of the work polishing apparatus 100. Details of each sections of the apparatus 100 will be described later.

The schematic structure of the apparatus 100 will be explained with reference to FIGS. 1 and 2.

A driving section 104 drives a polishing section 102 so as to polish a work (not shown). Polishing results of the work (e.g., polishing rate, surface roughness) are measured by a polishing result measuring section 106, whose structure is known.

A driving section 110 drives a dressing section 108 so as to dress a polishing pad adhered on a polishing plate of the polishing section 102 under prescribed dressing conditions.

A surface property measuring section 112 measures surface properties of the polishing pad. Concretely, the surface property measuring section 112 measures parameters: number of contact points between the polishing pad and a measuring device (e.g., dove prism); contact ratios; spacings of contact points; and half-value widths of spatial FFT result.

In the present embodiment, the apparatus comprises an artificial intelligence including a first neural network ("neural network" is hereinafter referred to as "NN") 114 and a second neural network 122. Dressing condition data used in the dressing section 108 (they are not inputted to the first NN in the flowchart of FIG. 2), surface property data of the polishing pad measured by the surface property measuring section 112 and polishing result data measured by the polishing result measuring section 106 are inputted to the first neural network 114. The first NN 114 calculates and learns correlations between the inputted data according to programs stored in a storing section 116, and the learned results are stored in a storing section 118. It was found that there are correlations between the surface property data and the polishing result data by analyzing many data of experimental polishing values and actual polishing values. These correlations are gradually updated to make precise data by learning.

An operator inputs object polishing result data through an input section 120. Therefore, the object polishing result data are inputted to the first NN 114 (Step S1).

The first NN 114 outputs estimated polishing result data on the basis of the inputted object polishing result data (Step S2), and outputs estimated surface property data, which are obtained by inversely estimating the estimated polishing result data on the basis of the correlations between said data (Step S3).

The estimated surface property data outputted from the first NN 114 are inputted to the second NN 122 (Step S4).

In the second NN 122, estimated dressing condition data of the polishing pad, from which the inputted estimated surface property data can be derived from the correlations between said data, according to programs stored in a storing section 124, are determined (Step S5).

Then, in Step S7, the produced surface property data of the polishing pad are measured. Further, in the second NN 122, a teacher signal corresponding to the estimated dressing condition is inputted to an output neuron via the storing section 118 and learned by a back propagation method, so that the correlation data can be updated.

The operator drives the dressing section 108 by actuating the driving section 110 and dresses the polishing pad with using the estimated dressing condition data (Step S6). After dressing the polishing pad, the polishing pad is cleaned, and its surface properties are measured by the surface property measuring section 112 (Step S7).

After dressing the polishing pad, the polishing section 102 is driven by the driving section 104 so as to polish the work (Step S8).

After polishing the work, work polishing results, e.g., polishing rate, are measured by the polishing result measuring section 106 (Step S9).

The surface property data of the polishing pad measured in Step S7 and the polishing result data of the work measured in Step S9 are inputted to the first NN 114, and required learning is performed, so that the learning values are updated in the storing section 118.

Note that, the data and the learning values inputted to the first NN 114 are shared with the second NN 122 through the storing section 118.

In Step S10, the polishing results of the work measured in Step S9 are judged. If the work polishing result data are within a prescribed range, polishing the next work is performed (Step S11). When the work is polished a prescribed amount, the polishing process is completed (Step S12).

In Step S10, if the measured polishing result data of the work are out of the prescribed range, the action is returned to Step S1 to redress the polishing pad, or if a prescribed number of batches of the works are completed, the polishing pad is exchanged according to operator's judgement (Step S13). In this case, if a type of the new polishing pad is the same as that of the former polishing pad, the learning values stored in the first NN 114 and the second NN 122 can be used, as they are, without change. After exchanging the polishing pad, the action is returned to Step S1.

Note that, the actions of each section are controlled by a control section (not shown) according to prescribed programs.

Next, each section of the work polishing apparatus will be explained.

Polishing Section 102

Figure 3:
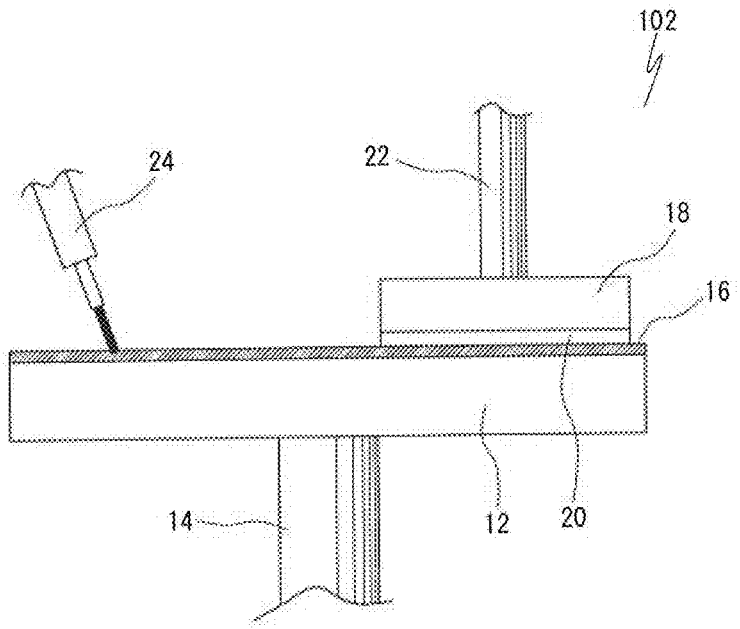
FIG. 3 is a schematic explanation view of a polishing section.

FIG. 3 is a schematic explanation view of a structure of the polishing section 102.

A polishing plate 12 is driven by a known driving mechanism (not shown) and rotated about a rotary shaft 14 in a horizontal plane. A polishing pad 16, which is mainly composed of, for example, urethane foam, is adhered on an upper face of the polishing plate 12.

A work (e.g., semiconductor wafer) 20 is held on a lower face of a polishing head 18. The polishing head 18 is rotated about a rotary shaft 22. Further, the polishing head 18 is moved upward and downward by a vertical driving mechanism (not shown), e.g., cylinder unit.

A slurry supplying nozzle 24 supplies slurry (polishing liquid) onto the polishing pad 16.

The work 20 is held on the lower face of the polishing head 18 by surface tension of water, air suction, etc. The polishing head 18 is moved downward and pressed onto the polishing pad 16 of the polishing plate 12 rotating in the horizontal plane with applying a prescribed pressing force (e.g., 150 gf/cm$^2$). Further, the polishing head 18 is rotated about the rotary shaft 22, so that a lower surface of the work can be polished. Slurry is supplied onto the polishing pad 16, from the slurry supplying nozzle 24, while polishing the work 20.

Note that, various types of the polishing heads are known, so a type of the polishing head 18 is not limited.

Dressing Section 108

Figure 4:
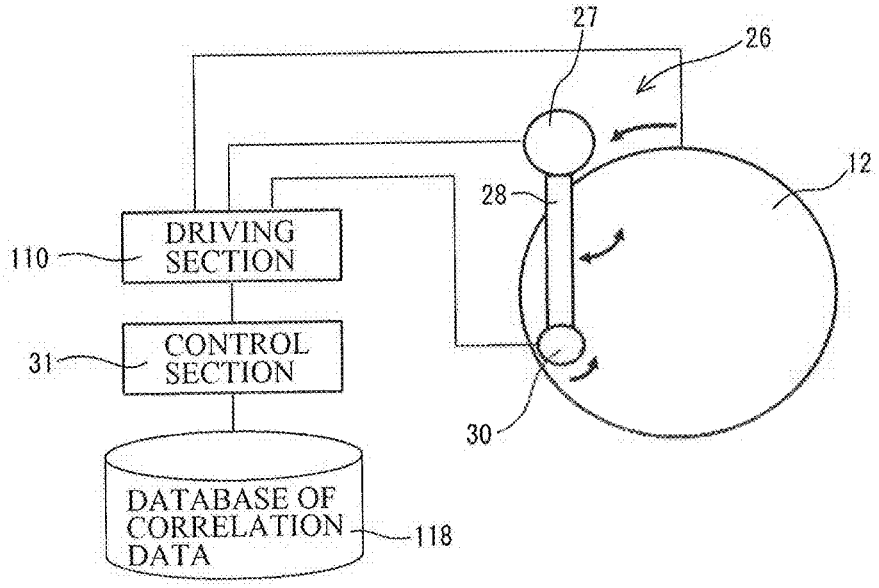
FIG. 4 is an explanation view of a dressing section.

FIG. 4 is a plan explanation view of a structure of the dressing section 108.

The dressing section 108 has a swing arm 28 which is capable of turning about a rotary shaft 27. A dressing head 30 is fixed to a front end of the swing arm 28. Dressing grindstones, each of which includes diamond abrasive grains having a prescribed grain size, are provided on a lower side of the dressing head 30. The dressing head 30, which is provided to the front end of the swing arm 28, is capable of rotating about its own axis.

A control section 31 instructs to dress the polishing pad 16, and the dressing process is performed by steps of: actuating the driving sections 104 and 110; rotating the polishing plate 12; turning the swing arm 28 about the rotary shaft 27; rotating the dressing head 30 about its own axis; and reciprocally moving the dressing head 30 in a radial direction of the polishing plate 12. By performing these steps, a surface of the polishing pad 16 is abraded by the dressing grindstones, so that the polishing pad 16 can be dressed. Note that, the above described data (i.e., correlation data) are stored in a storing section 118.

While dressing the polishing pad 16, the dressing head 30 presses the polishing pad 16 with a prescribed pressing force. To evenly dress the entire surface of the polishing pad 16, a rotational speed of the polishing plate 12 and a turning speed of the swing arm 28 may be suitably controlled.

Figure 5:
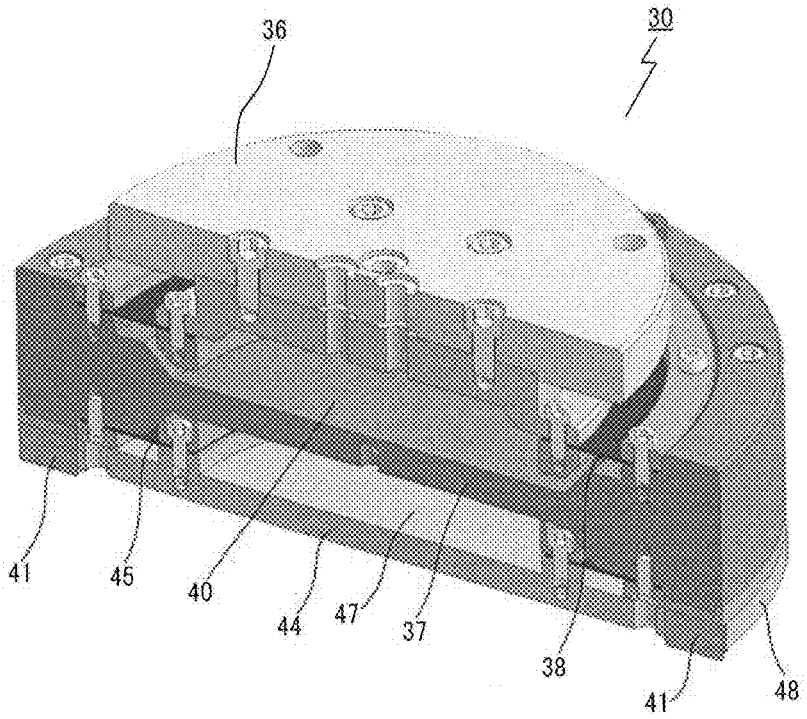
FIG. 5 is a perspective sectional view of a dressing head.
Figure 6:
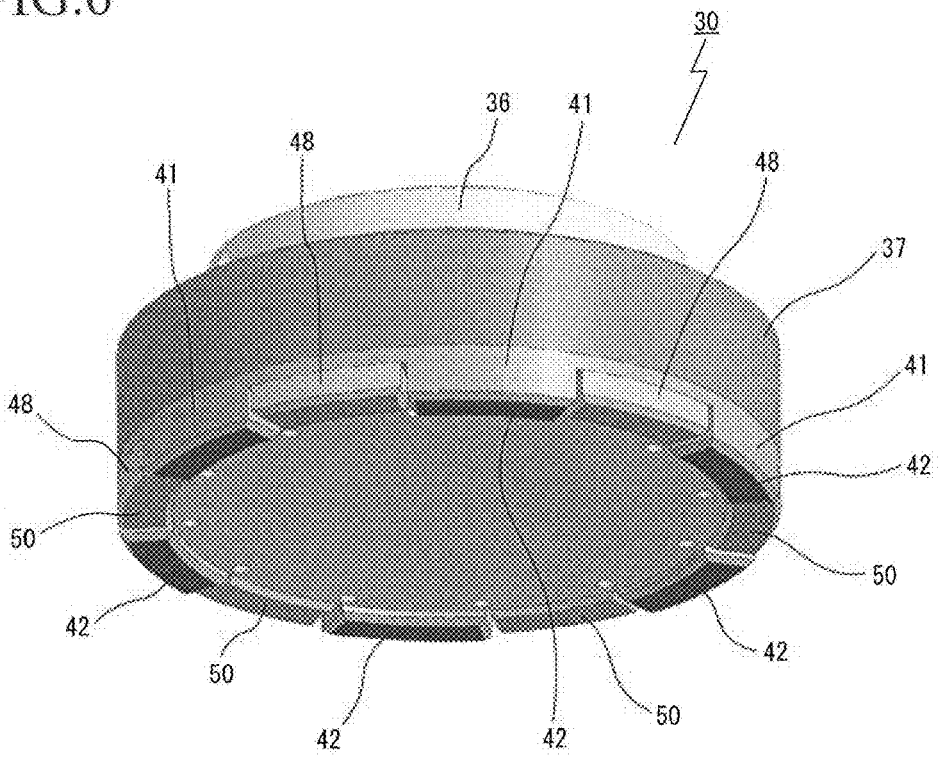
FIG. 6 is a perspective view of the dressing head.

An example of the dressing head 30 is shown in FIGS. 5 and 6.

A symbol 36 stands for a main body part of the dressing head 30.

A first movable plate 37 is attached to the main body part 36 with a flexible diaphragm 38, so that the first movable plate 37 can be moved upward and downward with respect to the main body part 36.

A first pressure chamber 40 is formed between a lower face of the main body part 36, a lower face of the diaphragm 38 and an upper face of the first movable plate 37. Compressed air can be introduced into the first pressure chamber 40 from a pressure source (not shown) via a flow passage (not shown).

A plurality of projecting parts 41 are formed in an outer edge part of a lower face of the first movable plate 37, and they are arranged in a circumferential direction at a prescribed interval. Dressing grindstones 42, each of which includes diamond abrasive grains having a grain size of, for example, #80, are respectively fixed to lower faces of the projecting parts 41.

In FIG. 5, a second movable plate 44 is attached to a lower face of the first movable plate 37 with a flexible diaphragm 45, so that the second movable plate 44 can be moved upward and downward with respect to the first movable plate 37.

A second pressure chamber 47 is formed between the lower face of the first movable plate 37, an upper face of the diaphragm 45 and an upper face of the second movable plate 44. Compressed air can be introduced into the second pressure chamber 47 from a pressure source (not shown) via a flow passage (not shown).

A plurality of projecting parts 48 are formed in an outer edge part of a lower face of the second movable plate 44, and they are arranged in a circumferential direction at a prescribed interval. Each of the projecting part 48 is located between the adjacent projecting parts 41 and 41. Therefore, the projecting parts 41 and the projecting parts 48 are provided on the same circumference. Dressing grindstones 50, each of which includes diamond abrasive grains having a grain size of, for example, #1000, are respectively fixed to lower faces of the projecting parts 48.

When compressed air is introduced into the first pressure chamber 40 and the second pressure chamber 47 from the flow passages (not shown), the dressing grindstones 42 and 50 are independently projected downward and pressed onto the polishing pad 16, so that the polishing pad 16 can be dressed. Note that, the dressing grindstones 42 and 50 can be simultaneously pressed onto the polishing pad 16, so that the polishing pad 16 can be dressed by both of the dressing grindstones 42 and 50 simultaneously.

Note that, in the above described embodiment, the grain sizes of the dressing grindstones are #80 and #1000. In some cases, a third movable plate (not shown), which can be moved upward and downward with respect to the second movable plate 44, may be attached by the same manner, and dressing grindstones having a grain size of, for example, #500 may be respectively provided to lower faces of projecting parts of the third movable plate. In this case, three-stage dressing can be performed by the dressing grindstones of #80, #500 and #1000.

Surface Property Measuring Section 112

Next, a surface property measuring section 112 and a manner for measuring surface properties (e.g., number of contact points) will be explained.

The measuring manner employed in the present embodiment is disclosed by Japanese Patent No. 5366041.

Figure 7:
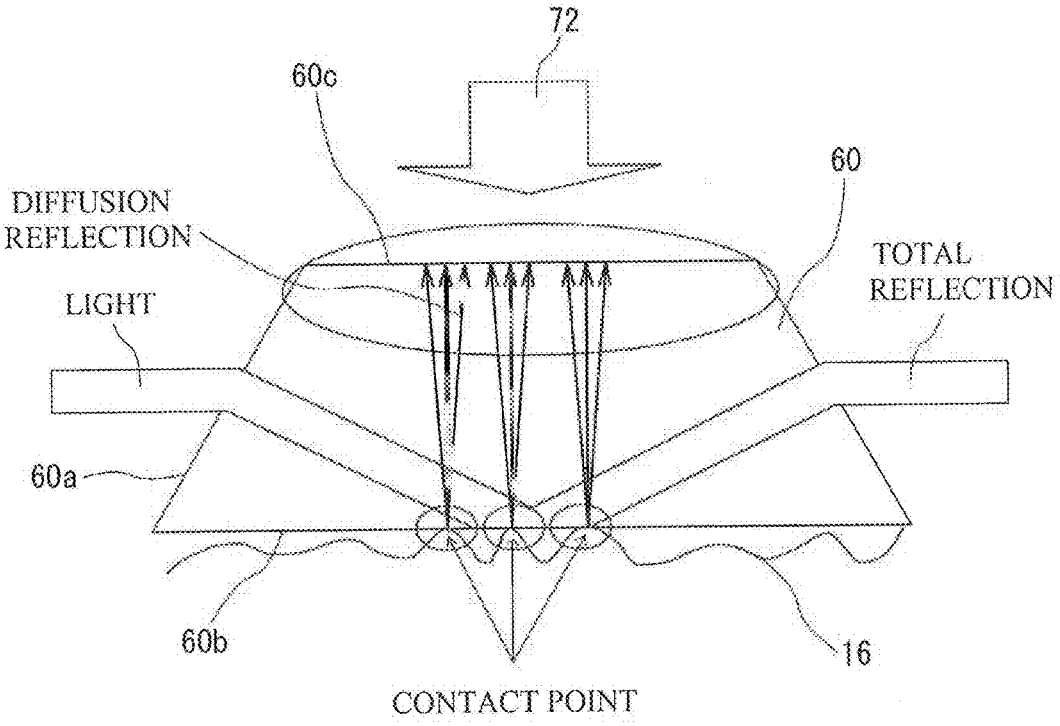
FIG. 7 is an explanation view in which a microscope receives a diffusion reflected light through a dove prism.

In Japanese Patent No. 5366041, a surface property of a polishing pad is observed by using a dove prism. The dove prism is one of optical glasses and called "image rotating prism". As shown in FIG. 7, in a dove prism 60, a light which has entered a light incident surface 60*a* at an angle of 45 degrees from a light source (not shown) is totally reflected on a bottom surface (contact surface) 60*b*, then passes the prism 60. Note that, conditions of total reflection are broken at contact points (i.e., points contacting the polishing pad), so the light is diffused and reflected. In other parts (noncontact points) except the contact points contacting the polishing pad, the light is totally reflected. The light incident surface 60*a* has an acute angle with respect to the contact surface 60*b*. Note that, the prism is not limited to the dove prism, which is formed into a trapezoidal shape shown in FIG. 7.

In the present embodiment, a contact image between the polishing pad 16 and the dove prism 60 is obtained by receiving reflected lights, which have diffused at and reflected from contact points, by using a light receiving section (e.g., microscope) with applying a prescribed pressure to the polishing pad 16 through the dove prism 60.

The microscope can obtain the contact image whose area is 7.3 mm×5.5 mm and whose pixel size is 1600 pixels×1600 pixels.

Note that, in the contact image, contact parts become white, and noncontact parts become black. In the present embodiment, the microscope 72 photographs the reflected lights, which are emitted from an upper face (observation surface) 60*c* of the dove prism 60, with applying a prescribed pressure to the polishing pad 16 through the dove prism 60.

The contact image obtained by the light receiving section 72 is binarized, so the image is made white and black. Then, number of the contact points, contact ratios, spacings of the contact points and half-value widths of spatial FFT results, etc. are calculated from the binarized image data so as to perform image diagnosis.

Note that, the image diagnosis of the surface condition of the polishing pad is not limited to the above described manner using the binarized image data, which are binarized by a threshold value. Other manners, e.g., observing distribution of gray scale values (gray scale histogram), may be employed.

Figure 8:
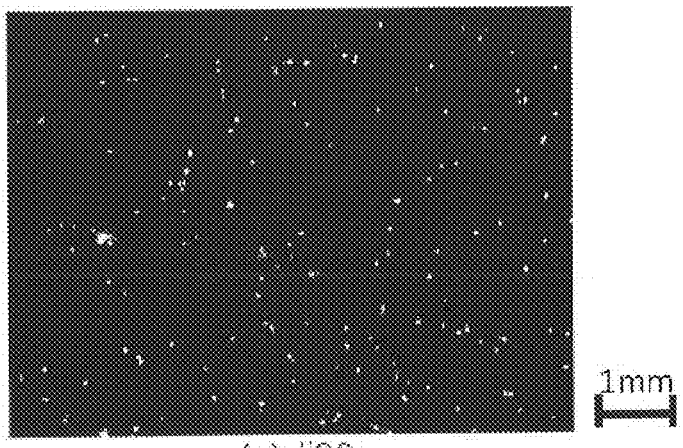
FIG. 8 is an explanation view showing a contact image between a polishing pad, which was dressed by a dressing grindstone of #80, and the dove prism, and the contact image was measured by the microscope through the dove prism.
Figure 9:
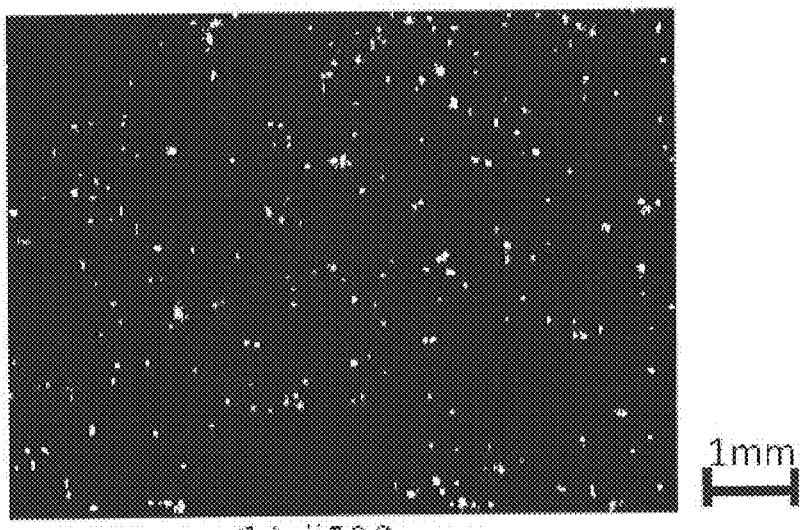
FIG. 9 is an explanation view showing a contact image between a polishing pad, which was dressed by a dressing grindstone of #500, and the dove prism, and the contact image was measured by the microscope through the dove prism.
Figure 10:
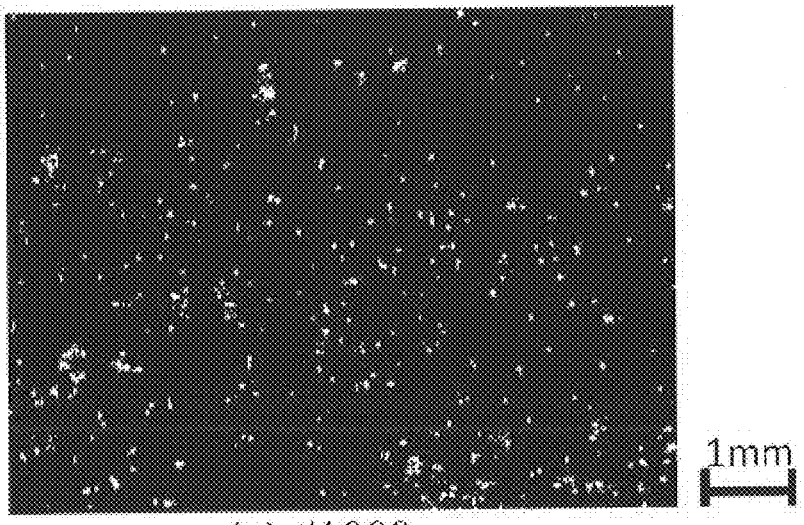
FIG. 10 is an explanation view showing a contact image between a polishing pad, which was dressed by a dressing grindstone of #1000, and the dove prism, and the contact image was measured by the microscope through the dove prism.

FIGS. 8-10 show contact images between the polishing pads 16, which were respectively dressed by dressing grindstones of #80, #500 and #1000, and the dove prism. They were measured by the microscope with using the dove prism. As clearly shown in FIGS. 8-10, number of contact points was increased when the dressing was performed by the dressing grindstone whose average grain size was smaller.

Figure 11:
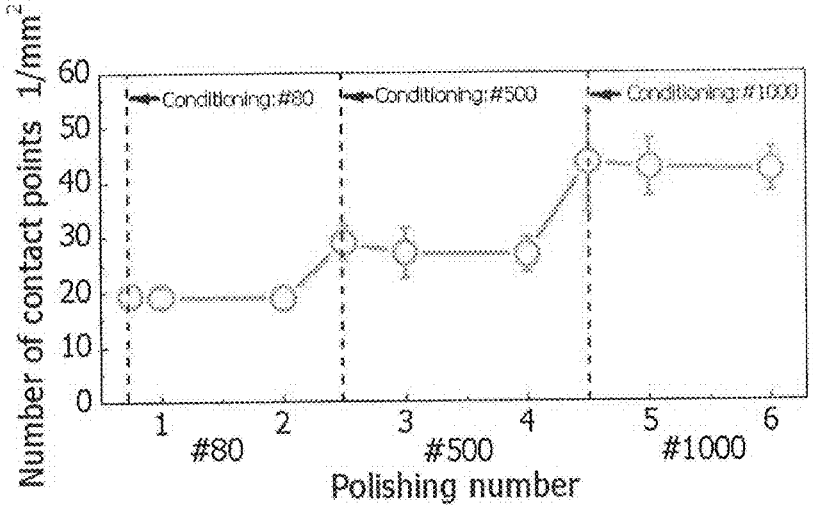
FIG. 11 is a graph showing a relation between grain sizes of a dressing grindstone and measured results of a surface property (number of contact points) of the polishing pad.

FIG. 11 is a graph showing a relation between grain sizes of the dressing grindstone and measured results of the surface property (number of contact points) of the polishing pad 16. The concrete measured values are shown in TABLE 1.

TABLE 1

| Number of Dressing or Polishing | Number of Contact Points 1/mm$^2$ |
|---|---|
| Dressing with Grindstone of #80 | 19.4 |
| First Polishing | 19.2 |
| Second Polishing | 18.9 |
| Dressing with Grindstone of #500 | 28.8 |
| Third Polishing | 27.0 |
| Fourth Polishing | 26.7 |
| Dressing with Grindstone of #1000 | 43.5 |
| Fifth Polishing | 42.4 |
| Sixth Polishing | 42.1 |

In FIG. 11 and TABLE 1, the item "number of contact points 19.4" indicates that the number of contact points between the polishing pad 16, which were dressed by the grindstone of #80, and the dove prism was 19.4/mm$^2$; the item "First Polishing" indicates that the number of contact points between the dressed polishing pad 16, which polished the work 20 once, and the dove prism was 19.2/mm$^2$; and the item "Second Polishing" indicates that the number of contact points between the dressed polishing pad 16, which polished the work 20 twice, and the dove prism was 18.9/mm$^2$.

The item "Dressing with Grindstone of #500" indicates that the polishing pad was further dressed by the grindstone of #500 after being dressed by the grindstone of #80.

The item "Dressing with Grindstone of #1000" indicates that the polishing pad was further dressed by the grindstone of #1000 after being dressed by the grindstones of #80 and #500.

The number of contact points was increased when the dressing was performed by the dressing grindstone whose average grain size was smaller, and a polishing rate was also increased as described later.

However, in each of the dressing stages, the number of contact points was not significantly reduced between number of times of polishing. Of course, the number of contact points were reduced with increasing the number of times of polishing. Namely, the number of contact points were gradually reduced with progressing deterioration of the surface of the polishing pad.

Figure 12:
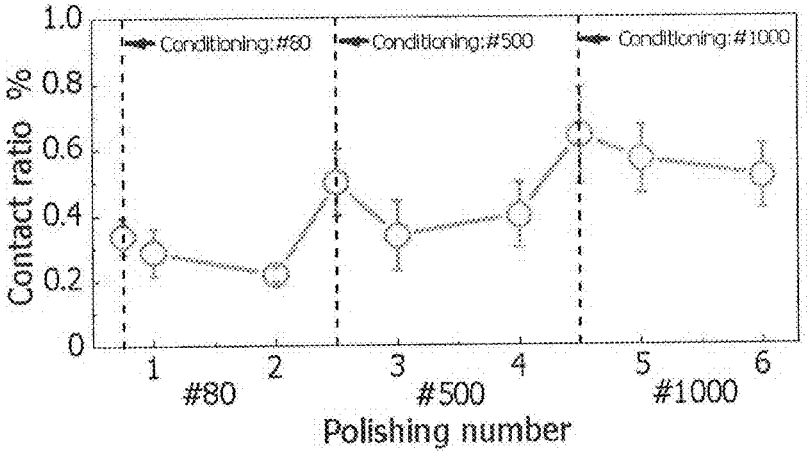
FIG. 12 is a graph showing a relation between grain sizes of a dressing grindstone and measured results of a surface property (contact ratio) of the polishing pad.

FIG. 12 is a graph showing a relation between grain sizes of the dressing grindstone and measured results of the surface property (contact ratios) of the polishing pad 16. The concrete measured values are shown in TABLE 2.

TABLE 2

| Number of Dressing or Polishing | Contact Ratio % |
|---|---|
| Dressing with Grindstone of #80 | 0.337 |
| First Polishing | 0.288 |
| Second Polishing | 0.218 |
| Dressing with Grindstone of #500 | 0.499 |
| Third Polishing | 0.336 |
| Fourth Polishing | 0.399 |
| Dressing with Grindstone of #1000 | 0.641 |
| Fifth Polishing | 0.567 |
| Sixth Polishing | 0.514 |

As shown in FIG. 12 and TABLE 2, in each of the dressing stages, the contact ratios were widely varied according to the number of times of polishing.

Note that, the contact ratio is a ratio of an actual contact area in the obtained contact image (a total area of contact parts observed in the contact image) to an apparent contact area therein (an area of the observed contact image). To calculate the contact ratio, the contact image obtained by the light receiving section 72 is binarized, so the image is made white and black. Then, the ratio of white to black in the binarized image data is calculated.

Figure 13:
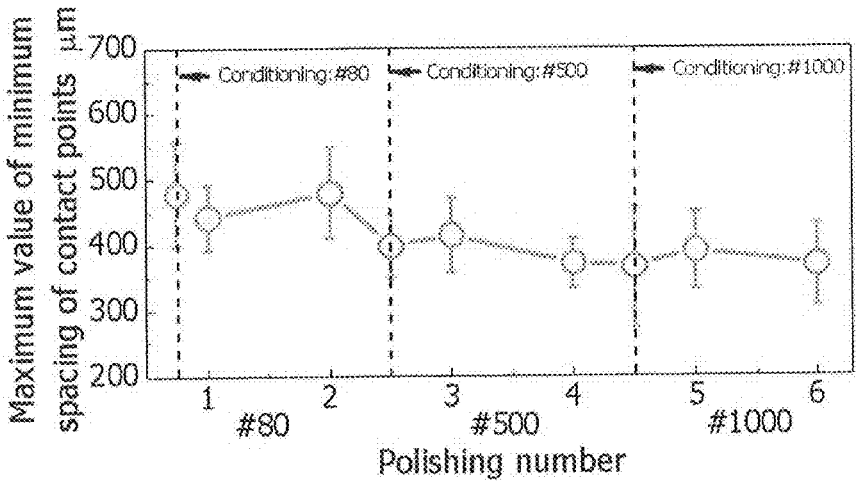
FIG. 13 is a graph showing a relation between grain sizes of a dressing grindstone and measured results of a surface property (spacings of contact points) of the polishing pad.

FIG. 13 is a graph showing a relation between grain sizes of the dressing grindstone and measured results of a surface property (spacings of contact points) of the polishing pad 16. The concrete measured values are shown in TABLE 3.

TABLE 3

| Number of Dressing or Polishing | Spacing of Contact Points μm |
|---|---|
| Dressing with Grindstone of #80 | 477 |
| First Polishing | 441 |
| Second Polishing | 479 |
| Dressing with Grindstone of #500 | 398 |
| Third Polishing | 414 |
| Fourth Polishing | 371 |
| Dressing with Grindstone of #1000 | 366 |
| Fifth Polishing | 390 |
| Sixth Polishing | 368 |

As shown in FIG. 13 and TABLE 3, in each of the dressing stages, the spacings of contact points were widely varied according to the number of times of polishing.

Figure 14:
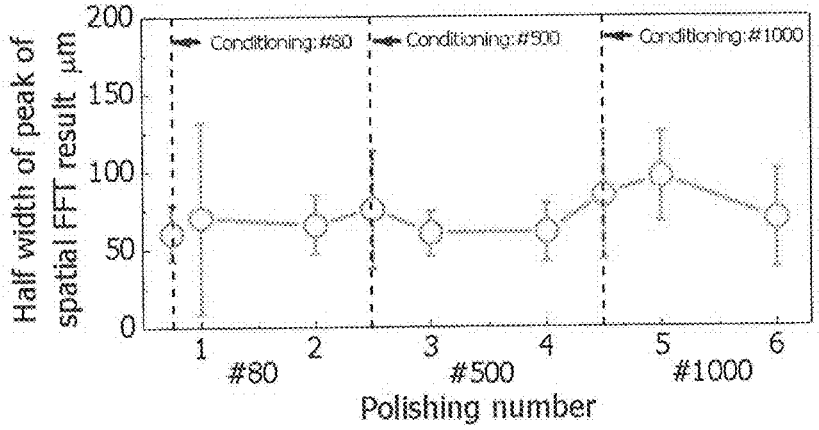
FIG. 14 is a graph showing a relation between grain sizes of a dressing grindstone and measured results of surface properties (spatial FFT results) of the polishing pad.

FIG. 14 is a graph showing a relation between grain sizes of a dressing grindstone and measured results of a surface property (spatial FFT results) of the polishing pad 16. The concrete measured values are shown in TABLE 4.

TABLE 4

| Number of Dressing or Polishing | Spatial FFT Analysis μm |
|---|---|
| Dressing with Grindstone of #80 | 60.7 |
| First Polishing | 70.6 |
| Second Polishing | 66.0 |
| Dressing with Grindstone of #500 | 75.8 |
| Third Polishing | 60.5 |
| Fourth Polishing | 61.2 |

TABLE 4-continued

| Number of Dressing or Polishing | Spatial FFT Analysis μm |
|---|---|
| Dressing with Grindstone of #1000 | 84.8 |
| Fifth Polishing | 96.7 |
| Sixth Polishing | 69.4 |

As shown in FIG. 14 and TABLE 4, in each of the dressing stages, the spatial FFT results were widely varied according to the number of times of polishing.

Note that, "FFT" is abbreviation of fast Fourier transform, and it is usually used to know frequency components of signal varying with respect to a time axis. On the other hand, "spatial FFT analysis" is an analyzing manner for knowing spatial frequency components included in an object image. Namely, it is can be regarded as a manner for quantitatively evaluating spacings between the contact points existing in obtained contact images corresponding to different dressing conditions. Namely, for example, in case that the spacing between the contact points are large, the spatial frequency is small. Therefore, a spectrum obtained by the spatial FFT analysis concentrates to a center frequency (=0), so a half-value width of the spectrum wave becomes small. Therefore, a spatial wave length, which is given as its inverse number, is long. To obtain the half-value width, the contact image obtained by the light receiving section 72 is binarized, so pixels in the contact image are made white and black. Then, the spatial FFT analysis of the binarized image data is performed.

Note that, the above described manner for measuring the surface properties of the polishing pad does not directly measure the surface properties thereof in the state where the work 20 and the polishing pad 16 contact each other. However, in the present embodiment, the surface properties are measured in the state where the dove prism is pressed onto the polishing pad 16 with the prescribed pressing force, so the measured surface properties of the polishing pad 16 are similar to those of the polishing pad 16 which contacts the work 20. Therefore, the described measuring manner can reflect the state of polishing the work 20.

On the other hand, in PTL 1 (Japanese Laid-open Patent Publication No. 2001-260001), the surface property of the polishing head is measured by the noncontact manner, so an actual contact state between the work and the polishing pad cannot be known.

Step of Obtaining Correlation Data

TABLES 5 and 6 show examples of correlations between the surface properties of the polishing pad 16, which was dressed under a plurality of dressing conditions, and polishing effects of the work 20, which was polished by the polishing pad 16 dressed under said dressing conditions. Note that, in the present embodiment, three dressing heads, which respectively had the dressing grindstones of #80, #500 and #1000, were prepared to perform the dressing under a plurality of dressing conditions. The dressing heads respectively corresponded to the dressing conditions. Each polishing was performed under two stages of conditions, i.e., low load (30 kPa) and high load (90 kPa).

TABLE 5

Relation between Polishing Conditions and Grindstone Number

| Polishing Conditions | | Dressing Conditions |
|---|---|---|
| Condition 1 (Work, Load) | Polishing Effects (Rate nm/min) | Condition 2 Grindstone Number |
| Sapphire, | 2.55 | #80 |
| 4 inches, | 4.77 | #500 |
| Low Load (30 kPa) | 5.28 | #1000 |
| Sapphire, | 68.2 | #80 |
| 4 inches, | 102 | #500 |
| High Load (90 kPa) | 155 | #1000 |

TABLE 6

Relation between Number of Contact Points and Grindstone Number

| Grindstone Number | Number of Contact Points $1/mm^2$ |
|---|---|
| #80 | 19.4 |
| #500 | 28.8 |
| #1000 | 43.5 |

TABLE 5 shows polishing rates (polishing effects) of polishing the work 20, which was polished under Condition 1 (two stages of pressing forces) of TABLE 5 by the polishing pads 16 which were respectively dressed by the dressing grindstones of #80, #500 and #1000 (Condition 2). TABLE 6 shows surface properties (number of contact points) of the polishing pad 16, which was dressed by the dressing grindstones of #80, #500 and #1000.

As clearly shown in TABLES 5 and 6, the polishing rate was increased when the work is polished by the polishing pad which had been dressed by the dressing grindstone of smaller grindstone number, so it is found that a high polishing effect could be obtained by using the dressing grindstone of smaller grindstone number.

As to Condition 1 of Polishing Conditions, the polishing object (i.e., work) composed of sapphire is used, but the polishing object may be composed of other materials, e.g., Si, SiC, may be used. Polishing conditions may be set according to the materials of the polishing object. Number of stages of the pressing forces (i.e., loads) for polishing the work may be increased, such as three stages, four stages, etc. Further, the rotational speed of the polishing plate 12, the rotational speed of the polishing head 18, etc. may be set at multistages.

Further, as to Dressing Conditions (Condition 2), the dressing conditions are basically set according to grain sizes of the dressing grindstones (number of dressing stage is not limited to three, so two stages, four stages or more may be set). Further, number of dressing stages may be set according to a dressing time, a dressing pressure, a turning speed of the swing arm 28, the rotational speed of the dressing head, the rotational speed of the polishing plate, etc.

In case of dressing the polishing pad by a dressing grindstone whose average grain size is small, e.g., #1000, it is preferable that the polishing pad is previously dressed by a dressing grindstone whose average grain size is large, e.g., #80, and then the dressing is performed by the dressing grindstone whose average grain size is small as described above. By stepwisely using the dressing grindstones from the large grain size to the small grain size, the number of contact points can be increased and the polishing pad 16 can be effectively dressed.

Figure 15:
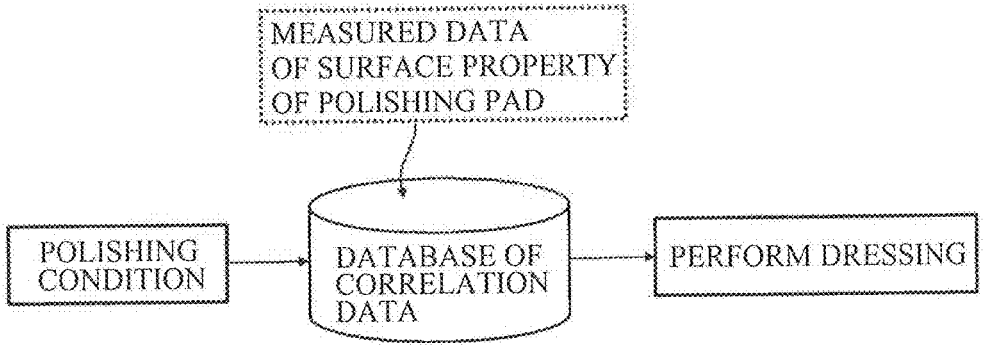
FIG. 15 is an explanation view in which correlation data between polishing conditions, dressing conditions and polishing results are previously stored as a database.

By the above described manner, correlation data between surface properties of the polishing pad 16 dressed under a plurality of dressing conditions and polishing effects of the work 20 which was polished under a plurality of polishing conditions by the polishing pad 16 dressed under each of the dressing conditions can be obtained (see FIG. 15).

The obtained correlation data are stored in the storing section 118 as a database, and data of test polishing or actual polishing are learned, so that the data in the database can be updated as better data.

First Neural Network (NN) 114

As described above, in the present embodiment, the contact image of the polishing pad is quantified, so that the data of the surface properties, i.e., number of contact points, contact ratios, spacings of contact points, spatial FFT analysis results, can be obtained. The data of the four surface properties include data highly correlated with the polishing effects and data lowly correlated therewith, so the first neural network 114 has a logical configuration including a step of weighting the data. Namely, the first NN 114 is a three-layer neural network. The data of the four surface properties of the polishing pad, which have been measured by the surface property measuring section 112 after dressing the polishing pad under a prescribed dressing condition, are inputted to the first NN 114 as input signals, and the first NN 114 calculates estimated polishing effects, e.g., polishing rate, on the basis of the correlation data stored in the storing section 118, then outputs the calculated effects (Step S2). Then, a teacher signal is inputted to a neuron and learned by the back propagation method, so that the correlation data are updated.

When an actual polishing process is performed, an operator inputs object polishing effect data to the input section 120, and the object polishing effect data are inputted to the first NN 114 (Step S1).

In the first NN 114, the back propagation method is performed to make an error zero, four estimated surface property data corresponding to the object polishing effect data are outputted (Step S3), and the estimated surface property data are inputted to the second NN 122 as they are without change.

A known driving configuration may be employed as a driving configuration of the first NN 114, so details of the driving configuration will be omitted.

Note that, in the above described embodiment, the quantified data (i.e., number of contact points, contact ratio, spacing of contact points, spatial FFT analysis), which are obtained by analyzing the contact image of the polishing pad, are used in the first NN 114, but the data need not be used therein. For example, data of the contact image may be directly used to calculate.

Second Neural Network (NN) 122

The second NN 122 is a three-layer neural network. The data of the four estimated surface property data of the polishing pad are inputted to the second NN 122 as input signals, and estimated dressing condition data corresponding to said data are outputted therefrom.

Namely, the four estimated surface property data outputted from the first NN 114 are inputted to the second NN 122, as they are without change, as input signals. Then, the second NN 122 calculates estimated dressing condition data, on the basis of the correlation data previously stored in the storing section 118, and outputs the calculated data (Step S5).

In the second NN 122, a teacher signal corresponding to the estimated dressing condition data is inputted to an output neuron, and learned by the back propagation method, so that the correlation data are updated as described above.

In case of deriving the estimated dressing condition data, dressing conditions are previously patterned (e.g., grindstone #80 only, combination of grindstones #80 and #500, combination of grindstones #80, #500 and #1000, combination of grindstone(s) and dressing time), and the estimated dressing condition data can be derived, on the basis of the correlation data between the surface property data of the polishing pad corresponding to the patterned dressing condition data and the polishing effect data, by, for example, K-nearest neighbor method of pattern recognition of machine learning.

A known driving configuration may be employed as a driving configuration of the second NN 122, so details of the driving configuration will be omitted.

Polishing Step

The following polishing process is performed according to the above described Steps S6-S13.

As described above, in the present embodiment, the contact image of the polishing pad is analyzed to quantify, so that the four surface property data, i.e., number of contact points, contact ratio, spacing of contact points, spatial FFT analysis, can be obtained. The correlation data between the four surface property data, the dressing condition data and the polishing effect data are obtained, and the neural networks are applied, so that the dressing conditions can be automatically obtained and the polishing apparatus can be automatized and made intelligent.

As described above, the dressing conditions (Condition 2) defining the surface properties are basically set according to grain sizes of the dressing grindstones (number of dressing stage is not limited to three, so two stages, four stages or more may be set). Further, number of dressing stages may be set according to a dressing time, a dressing pressure, a turning speed of the swing arm 28, the rotational speed of the dressing head, the rotational speed of the polishing plate, etc. In this case, further precise dressing condition data can be obtained, so that the polishing can be further effectively and precisely performed.

Note that, the dressing conditions are included in the polishing condition. Further, correlations between the dressing conditions, polishing conditions to which other measurable parameters, e.g., rotation number of the polishing plate, pressing force of the polishing head, temperature of slurry, temperature of a surface to be polished, air temperature, friction coefficient of the polishing pad, are added, and the polishing effects may be obtained, and the neural networks may be applied, so that the work can be further effectively and precisely polished.

The polishing apparatus may be an apparatus capable of polishing not only one side of a work but also both sides thereof.

Verifying Experiment 1

To perform a verifying experiment of the neural networks, learning data shown in FIG. 16 were produced.

To obtain the learning data, the polishing pad was actually dressed, and the surface properties of the polishing pad were measured. The obtained surface properties were number of contact points, contact ratio, spacing of contact points and half-value width of spatial FFT. Then, the polishing was performed, and polishing rates were measured. Dressing conditions were following six conditions:

Class A (○): Dressing with the grindstone of #80;

Class B (□): Dressing with the grindstone of #1000;

Class C (∇): Dressing with the grindstone of #80, then dressing with the grindstone of #500;

Class AC (Δ): Dressing with the grindstone of #80, then dressing with the grindstone of #1000;

Class BC (◇): Dressing with the grindstone of #500, then dressing with the grindstone of #1000; and Class CA (☆): Dressing with the grindstone of #1000, then dressing with the grindstone of #80.

The learning data were shown as Samples No. 1-75. Namely, there were 75 samples. They were correlation data between the dressing conditions of classes and the polishing effects.

Note that, as to the Samples No. 65 and 70-75, the dressing was not performed.

Figure 17:
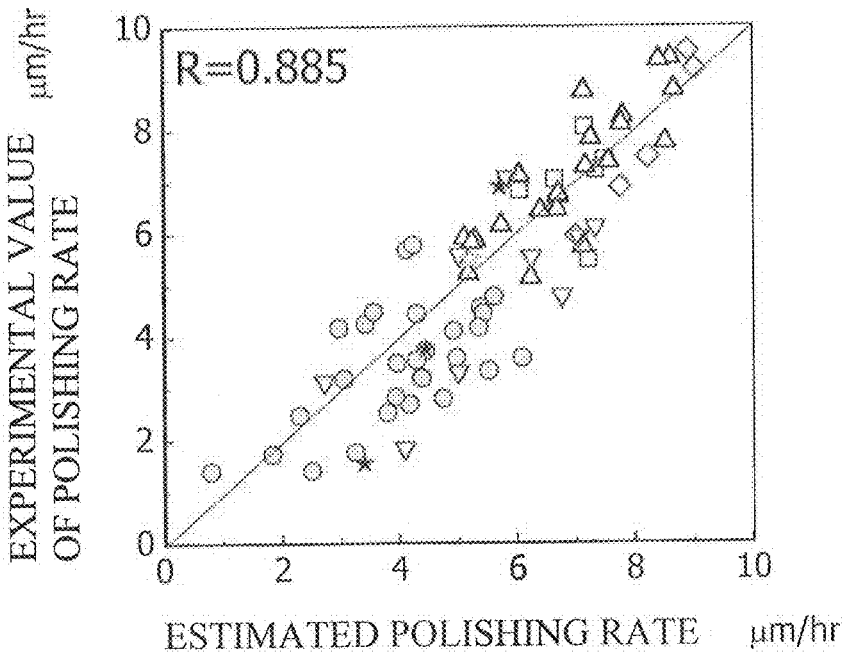
FIG. 17 is a graph showing a correlation between estimated polishing rates, which were estimated from learn data, and experimental values of the polishing rate.

The surface properties of the polishing pad at that time were identified from the polishing effects (experimental values) of the produced learning data, and a correlation between estimated polishing rates derived from the surface properties and the measured polishing rates (experimental values) was confirmed (see FIG. 17).

Figure 18:
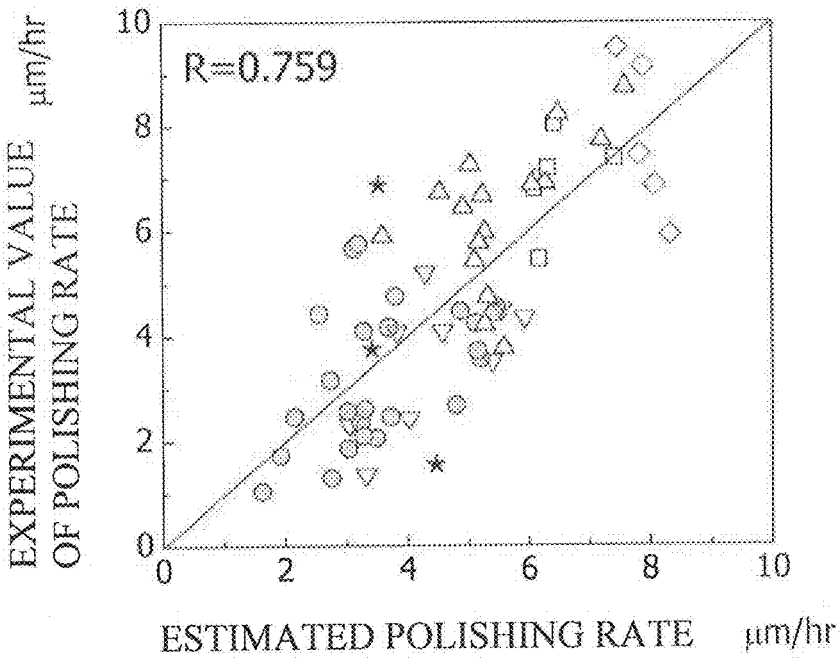
FIG. 18 is a graph showing a correlation between estimated polishing rates, which were obtained by multiple regression analysis, and experimental values of the polishing rate.

As to the results, a correlation coefficient (R) was 0.885 as shown in a graph of FIG. 17. In comparison with a correlation coefficient between estimated polishing rates obtained by multiple regression analysis and the experimental values of the polishing rates, i.e., R=0.759 (see FIG. 18), it was found that the results of the experiment had high correlation.

Namely, by producing the learning data and checking the correlation between the estimated polishing rates, which were derived from the surface properties, and the measured polishing rates (experimental values), it was found that the neural networks could be effectively used.

Verifying Experiment 2

To confirm effectiveness of deriving dressing conditions, the K-neighborhood method of pattern recognition of machine learning was tried. The experiment was performed under the following conditions: using the learning data of Verifying Experiment 1 (see FIG. 16); and estimated polishing rate=7.0.

Figure 19:
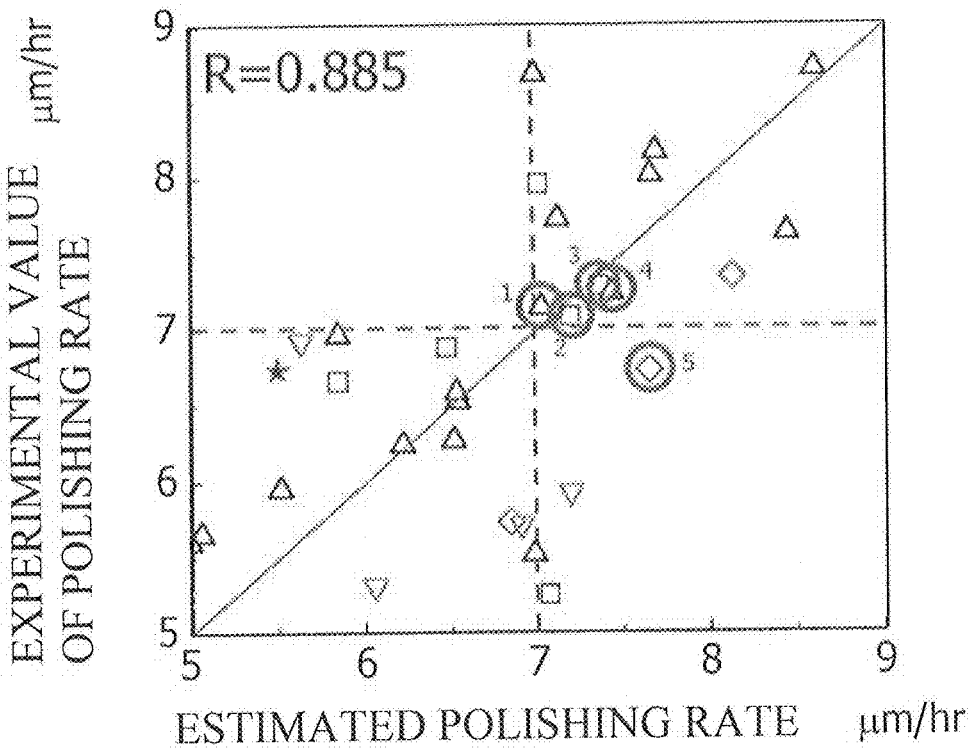
FIG. 19 is a partial enlarged view of the graph shown in FIG. 17, in which the polishing rate is around 7.0 μm/hr.

Results are shown in FIG. 19. Concretely, circled data were automatically selected. Note that, FIG. 19 is a partial enlarged view of the graph shown in FIG. 17, in which the polishing rate is around 7.0 μm/hr.

According to the circled data 1-5, classes and number of the dressing conditions were as follows: Class B was two; Class AC was two; and Class BC was one. In this case, both of Class B and Class AC were derived by a majority decision, so both of Classes B and AC were proposed. Further, selecting means for, for example, prioritizing dressing data whose experimental value is nearer to the estimated polishing rate may be provided.

In the above description, the dressing conditions were classified into six classes. Actually, subclasses, e.g., dressing time, may be used. Subclasses are produced by further classifying each of the six classes of the dressing conditions.

As to data distribution of FIG. 17, the data were biased according to the classes, so the pattern recognition technology can be effectively used by increasing data.

Verified Result

According to Verifying Experiments 1 and 2, it is found that the pattern recognition technology by machine learning can be theoretically and precisely performed.

Further, improving accuracy of polishing the work can be expected by increasing learning data and optimizing artificial intelligence.

If conditioning conditions can be proposed, every data of polishing conditions may be assembled to the system at any time with storing and checking correlations, so that the work polishing method and the work polishing apparatus can be automated and made intelligent.

What is claimed is:

1. A work polishing apparatus, in which a work is pressed onto a polishing pad of a rotating polishing plate with supplying slurry to the polishing pad so as to polish a surface of the work, comprising:

an artificial intelligence for analyzing data;

a dressing section having a grind stone, the grindstone being capable of reciprocally moving on a surface of the polishing pad so as to dress the surface of the polishing pad under a prescribed dressing condition;

a surface property measuring section for measuring a surface property of the polishing pad, the surface property measuring section obtaining a contact image of the polishing pad in a state of contacting the surface thereof;

a polishing result measuring section for measuring a polishing result of the work which has been polished by the polishing pad dressed by the dressing section;

a storing section for storing correlation data between dressing condition data for dressing the polishing pad by the dressing section, surface property data of the polishing pad measured by the surface property measuring section after dressing the polishing pad, and polishing results of the work polished after dressing the polishing pad, the correlation data being learned by the artificial intelligence; and an input section for inputting an object polishing result to the artificial intelligence, wherein a learning algorithm for performing a first arithmetic process, in which the surface property of the polishing pad corresponding to the object polishing result is inversely estimated on the basis of the correlation data, and a second arithmetic process, in which the corresponding dressing condition is derived on the basis of the surface property of the polishing pad inversely estimated, is mounted on the artificial intelligence.

2. The work polishing apparatus according to claim 1, wherein the dressing section has a plurality of grindstones to which abrasive grains having different grain sizes are respectively fixed.

3. The work polishing apparatus according to claim 1, wherein the surface property measuring section includes:

a dove prism having a light incident surface, a contact surface and an observation surface, the contact surface being pressed onto the surface of the polishing pad with a prescribed pressing force;

a light source for making a light enter the light incident surface of the dove prism;

a light receiving section for receiving the light which has been made enter the light incident surface of the dove prism, diffused and reflected at contact points of the contact surface thereof and the polishing pad and emitted from the observation surface thereof.

4. The work polishing apparatus according to claim 1, wherein the surface property of the polishing pad includes at least number of contact points in the contact image.

5. The work polishing apparatus according to claim 1, wherein the surface property of the polishing pad includes number of contact points, a contact ratio, a spacing between the contact points and a spatial FFT analysis result in the contact image.

6. The work polishing apparatus according to claim 1, wherein the artificial intelligence performs the first arithmetic process for inversely estimating the surface property of the polishing pad by using a first neural network, and performs the second arithmetic process for deriving the dressing condition by using a second neural network.

7. The work polishing apparatus according to claim 4, wherein the artificial intelligence performs the first arithmetic process for inversely estimating the surface property of the polishing pad by using a first neural network, and performs the second arithmetic process for deriving the dressing condition by using a second neural network.

8. The work polishing apparatus according to claim 5, wherein the artificial intelligence performs the first arithmetic process for inversely estimating the surface property of the polishing pad by using a first neural network, and performs the second arithmetic process for deriving the dressing condition by using a second neural network.

9. The work polishing apparatus according to claim 1, wherein the artificial intelligence performs the first arithmetic process for inversely estimating the surface property of the polishing pad by using a neural network, and performs the second arithmetic process for deriving the dressing condition by using an image recognition technology.

10. The work polishing apparatus according to claim 4, wherein the artificial intelligence performs the first arithmetic process for inversely estimating the surface property of the polishing pad by using a neural network, and performs the second arithmetic process for deriving the dressing condition by using an image recognition technology.

11. The work polishing apparatus according to claim 5, wherein the artificial intelligence performs the first arithmetic process for inversely estimating the surface property of the polishing pad by using a neural network, and performs the second arithmetic process for deriving the dressing condition by using an image recognition technology.

12. A work polishing method, in which a work is pressed onto a polishing pad of a rotating polishing plate with supplying slurry to the polishing pad so as to polish a surface of the work, comprising:

a dressing step of reciprocally moving a grind stone on a surface of the polishing pad so as to dress the surface of the polishing pad under a prescribed dressing condition;

a measuring step of measuring a surface property of the polishing pad by a surface property measuring section, the surface property measuring section obtaining a contact image of the polishing pad in a state of contacting the surface thereof;

a polishing step of polishing the work after dressing the polishing pad;

a measuring step of measuring a polishing result of the polished work;

an obtaining step of obtaining correlation data between the dressing data for dressing the polishing pad by the dressing section, surface property data of the polishing pad measured by the surface property measuring section after dressing the polishing pad and polishing results of the work polished after dressing the polishing pad, which are learned by an artificial intelligence;

an inputting step of inputting an object polishing result to the artificial intelligence;

a first arithmetic step of inversely estimating the surface property of the polishing pad corresponding to the object polishing result on the basis of the correlation data by the artificial intelligence; and a second arithmetic step of deriving the corresponding dressing condition on the basis of the surface property of the polishing pad inversely estimated by the artificial intelligence.

13. The work polishing method according to claim 12, wherein the dressing step uses a plurality of grindstones to which abrasive grains having different grain sizes are respectively fixed.

14. The work polishing method according to claim 12, wherein the surface property of the polishing pad includes at least number of contact points in the contact image.

15. The work polishing method according to claim 12, wherein the surface property of the polishing pad includes number of contact points, a contact ratio, a spacing between the contact points and a spatial FFT analysis result in the contact image.

16. The work polishing method according to claim 12, wherein the artificial intelligence performs the first arithmetic process for inversely estimating the surface property of the polishing pad by using a first neural network, and performs the second arithmetic process for deriving the dressing condition by using a second neural network.

17. The work polishing method according to claim 14, wherein the artificial intelligence performs the first arithmetic process for inversely estimating the surface property of the polishing pad by using a first neural network, and performs the second arithmetic process for deriving the dressing condition by using a second neural network.

18. The work polishing method according to claim 15, wherein the artificial intelligence performs the first arithmetic process for inversely estimating the surface property of the polishing pad by using a first neural network, and performs the second arithmetic process for deriving the dressing condition by using a second neural network.

19. The work polishing method according to claim 12, wherein the artificial intelligence performs the first arithmetic process for inversely estimating the surface property of the polishing pad by using a neural network, and performs the second arithmetic process for deriving the dressing condition by using an image recognition technology.

20. The work polishing method according to claim 14, wherein the artificial intelligence performs the first arithmetic process for inversely estimating the surface property of the polishing pad by using a neural network, and performs the second arithmetic process for deriving the dressing condition by using an image recognition technology.

21. The work polishing method according to claim 15, wherein the artificial intelligence performs the first arithmetic process for inversely estimating the surface property of the polishing pad by using a neural network, and performs the second arithmetic process for deriving the dressing condition by using an image recognition technology.

* * * * *